US010590944B2

(12) United States Patent
Hu et al.

(10) Patent No.: US 10,590,944 B2
(45) Date of Patent: Mar. 17, 2020

(54) COOLING SYSTEM FOR COMPRESSOR AND METHOD FOR OPERATION THEREOF

(71) Applicant: Ford Global Technologies, LLC, Dearborn, MI (US)

(72) Inventors: Leon Hu, Bloomfield Hills, MI (US); Jianwen James Yi, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 212 days.

(21) Appl. No.: 15/726,273

(22) Filed: Oct. 5, 2017

(65) Prior Publication Data

US 2019/0107113 A1 Apr. 11, 2019

(51) Int. Cl.

| | |
|---|---|
| ***F04D 27/02*** | (2006.01) |
| ***F04D 29/58*** | (2006.01) |
| ***F04D 29/42*** | (2006.01) |
| ***F04D 29/68*** | (2006.01) |
| ***F04D 17/10*** | (2006.01) |
| ***F04D 27/00*** | (2006.01) |
| *F04D 29/28* | (2006.01) |

(52) U.S. Cl.

CPC ..... *F04D 27/0276* (2013.01); *F04D 17/10* (2013.01); *F04D 27/009* (2013.01); *F04D 29/4213* (2013.01); *F04D 29/584* (2013.01); *F04D 29/5826* (2013.01); *F04D 29/685* (2013.01); *F04D 29/284* (2013.01); *F04D 29/4206* (2013.01)

(58) Field of Classification Search

CPC .... F04D 27/0276; F04D 17/10; F04D 27/009; F04D 27/0246; F04D 29/5826; F04D 29/584; F04D 29/681; F04D 29/284; F04D 29/4206

USPC ..... 415/144

See application file for complete search history.

(56) References Cited

U.S. PATENT DOCUMENTS

| | | | | |
|---|---|---|---|---|
| 3,907,458 | A | 9/1975 | Liddle | |
| 4,693,667 | A | 9/1987 | Lenz et al. | |
| 4,704,075 | A | 11/1987 | Johnston et al. | |
| 4,930,978 | A | 6/1990 | Khanna et al. | |
| 4,979,881 | A | 12/1990 | Gutknecht | |
| 7,475,539 | B2 | 1/2009 | Chen | |
| 8,061,974 | B2 | 11/2011 | Gu et al. | |
| 8,511,083 | B2 | 8/2013 | Arnold et al. | |
| 8,517,664 | B2 | 8/2013 | Sun et al. | |
| 2009/0028730 | A1* | 1/2009 | Radermacher | F04D 29/4206 417/423.8 |
| 2013/0291540 | A1 | 11/2013 | Serres et al. | |
| 2014/0299112 | A1* | 10/2014 | Quix | F02B 33/34 123/559.1 |
| 2015/0377064 | A1 | 12/2015 | Celaya et al. | |
| 2016/0273548 | A1* | 9/2016 | Uesugi | F04D 29/5853 |
| 2017/0350420 | A1* | 12/2017 | Lucas | F04D 29/665 |

* cited by examiner

*Primary Examiner* — Joseph J Dallo
*Assistant Examiner* — Yi-Kai Wang
(74) *Attorney, Agent, or Firm* — Geoffrey Brumbaugh; McCoy Russell LLP

(57) ABSTRACT

Methods and systems are provided for cooling a compressor in an engine. In one example, a compressor with a liquid coolant passage extending through a section of a housing of the compressor adjacent to a bypass passage, is provide. The bypass passage enable airflow to be directed around a portion of a compressor impeller.

20 Claims, 5 Drawing Sheets

COOLING SYSTEM FOR COMPRESSOR AND METHOD FOR OPERATION THEREOF

FIELD

The present description relates generally to methods and systems for cooling a compressor in an internal combustion engine.

BACKGROUND/SUMMARY

Boosting devices such as turbochargers and superchargers utilize compressors to provide greater amounts of air to the combustion chamber during operation. Consequently, engine power may be increased while reducing emissions. However, during certain engine operating conditions the turbocharger compressor may experience undesirable phenomenon such as surge and choke. Compressor surge occurs when the pressure gradient across the impeller exceeds a threshold, such as during low speed and high throttle conditions. Conversely, compressor choke occurs when the impeller reaches or approaches a maximum flowrate, such as during high speed conditions.

Attempts have been made to alleviate compressor surge through the use of a ported shroud in the compressor. One example approach is shown by Chen in U.S. Pat. No. 7,475,539. Therein, a shrouded port bypassing a section of the compressor impeller is provided to recirculate air around the impeller during surge conditions and increase airflow to the impeller during choke conditions. Thus, Chen's shrouded port in essence increases the compressor's flow range and efficiency.

However, the inventors herein have recognized potential issues with such systems. As one example, during surge conditions the airflow through Chen's ported shroud has a high temperature due to the elevated pressure of the recirculated air. Consequently, the efficiency of the compressor decreases during surge conditions, thereby decreasing engine efficiency. Moreover, elevated temperatures in the compressor can increase the likelihood of thermal degradation of compressor components.

Other attempts have been made to use variable geometry compressors in an attempt to improve the compressor's flow range and efficiency. However, variable geometry compressor are costly and may be susceptible to malfunction due to the complexity of the adjustable geometry components.

Attempts have also been made to provide variable inlet guiding vanes to improve low end compressor efficiency. However, compressor employing variable inlet guiding vanes usually suffer from flow capacity limitations during high end compressor operation.

In one example, the issues described above may be addressed by a compressor including an impeller receiving air from an inlet passage, a housing surrounding the impeller, a bypass passage including a first passage port positioned downstream of a leading edge of the impeller and a second passage port positioned upstream of the leading edge, and a liquid coolant passage extending through a section of the housing at least partially surrounding the bypass passage. In this way, intake air flowing through the bypass passage can be cooled to increase the pressure of the intake air flowing through the compressor, thereby increasing compressor efficiency.

As one example, the liquid coolant passage may circumferentially surround a section of the bypass passage. In this way, the airflow through the compressor can be cooled to a greater extent, enabling additional cooling benefits to be achieved by the cooling system.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates a cooling system for a compressor. The cooling system includes a liquid coolant passage traversing a compressor housing adjacent to a bypass passage. The bypass passage acts as a ported shroud to expand the range of the compressor by enabling intake airflow upstream around the compressor's impeller during surge events, for instance. The cooling passage therefore acts to cool air traveling through the bypass passage to increase compressor efficiency as well as reduce the likelihood thermal degradation of compressor components. Consequently, engine efficiency is increased and emissions are correspondingly reduced. Moreover, the longevity of the compressor is also increased when a liquid coolant passage is provided in the compressor. In one example, the liquid coolant passage may circumferentially surround the bypass passage to enable a greater amount heat to be extracted from airflow through the bypass passage to further increase compressor cooling and therefore compressor efficiency.

Figure 1:
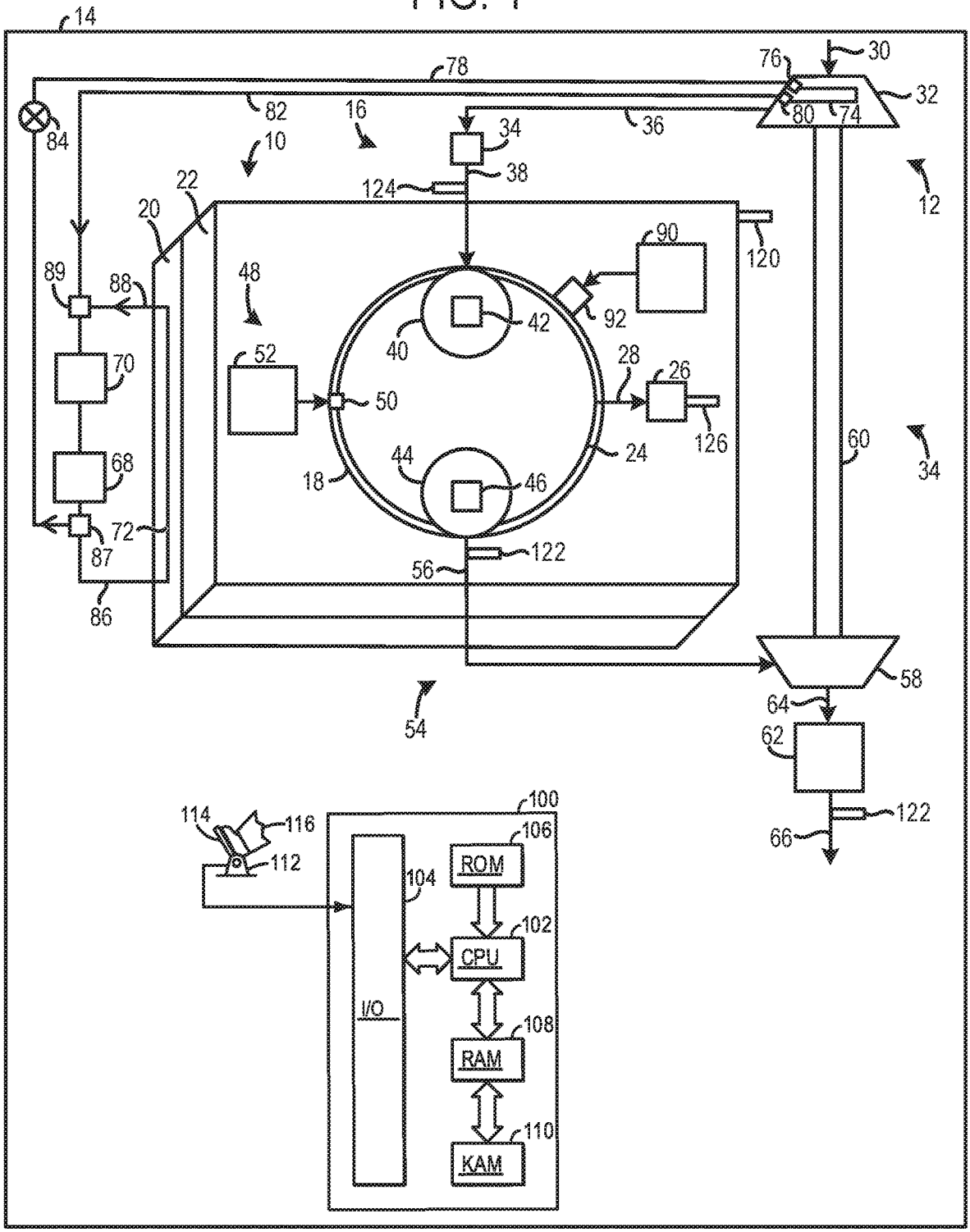
FIG. 1 shows a schematic depiction of an engine, turbocharger, and cooling system.
Figure 2:
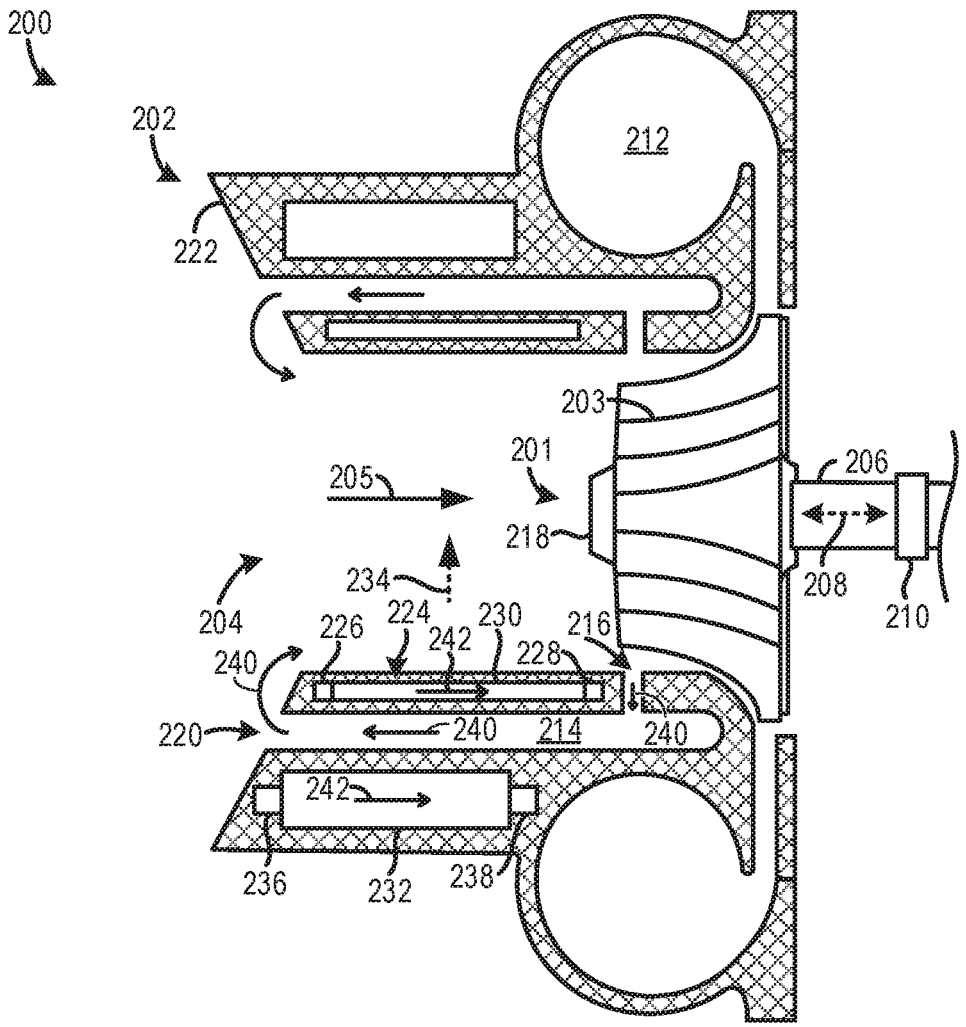
FIG. 2 shows an illustration of an exemplary compressor and cooling system during a compressor surge condition.
Figure 3:
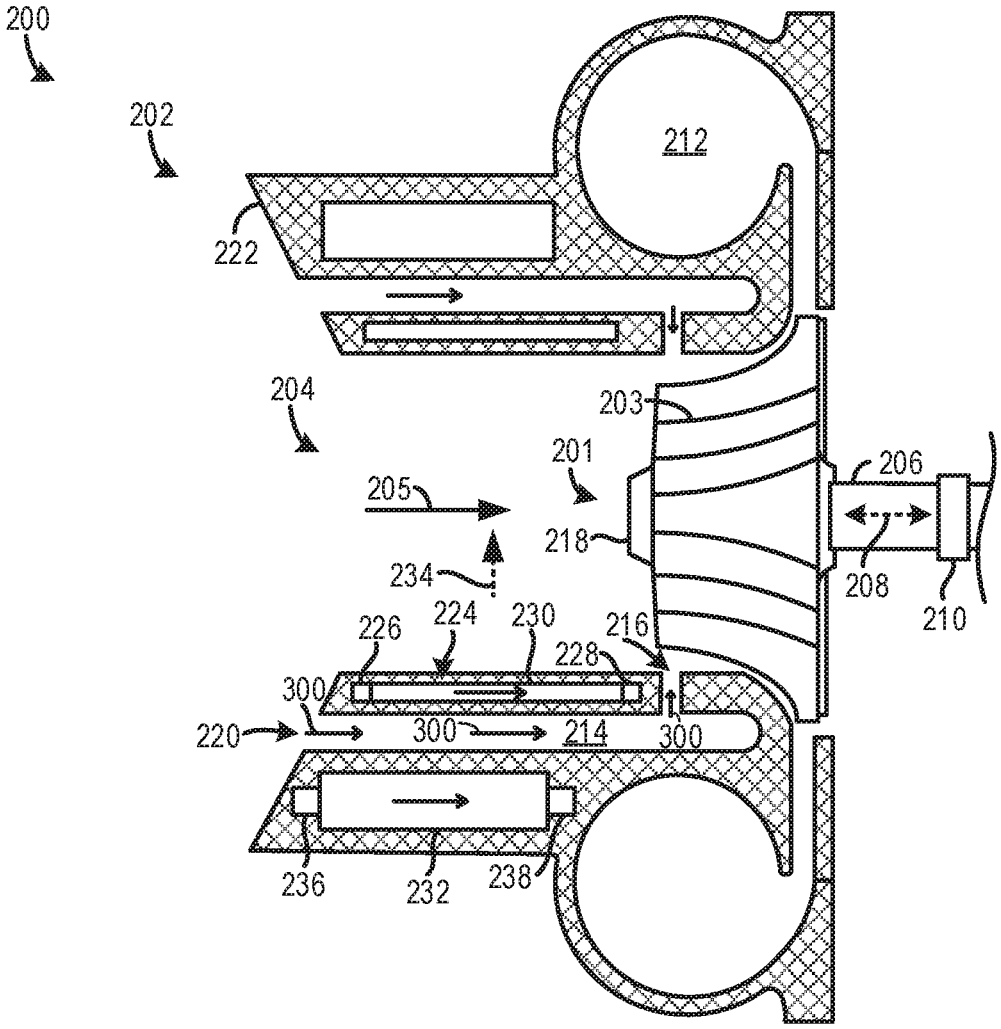
FIG. 3 shows an illustration of the compressor shown in FIG. 2 during a compressor choke condition.
Figure 4:
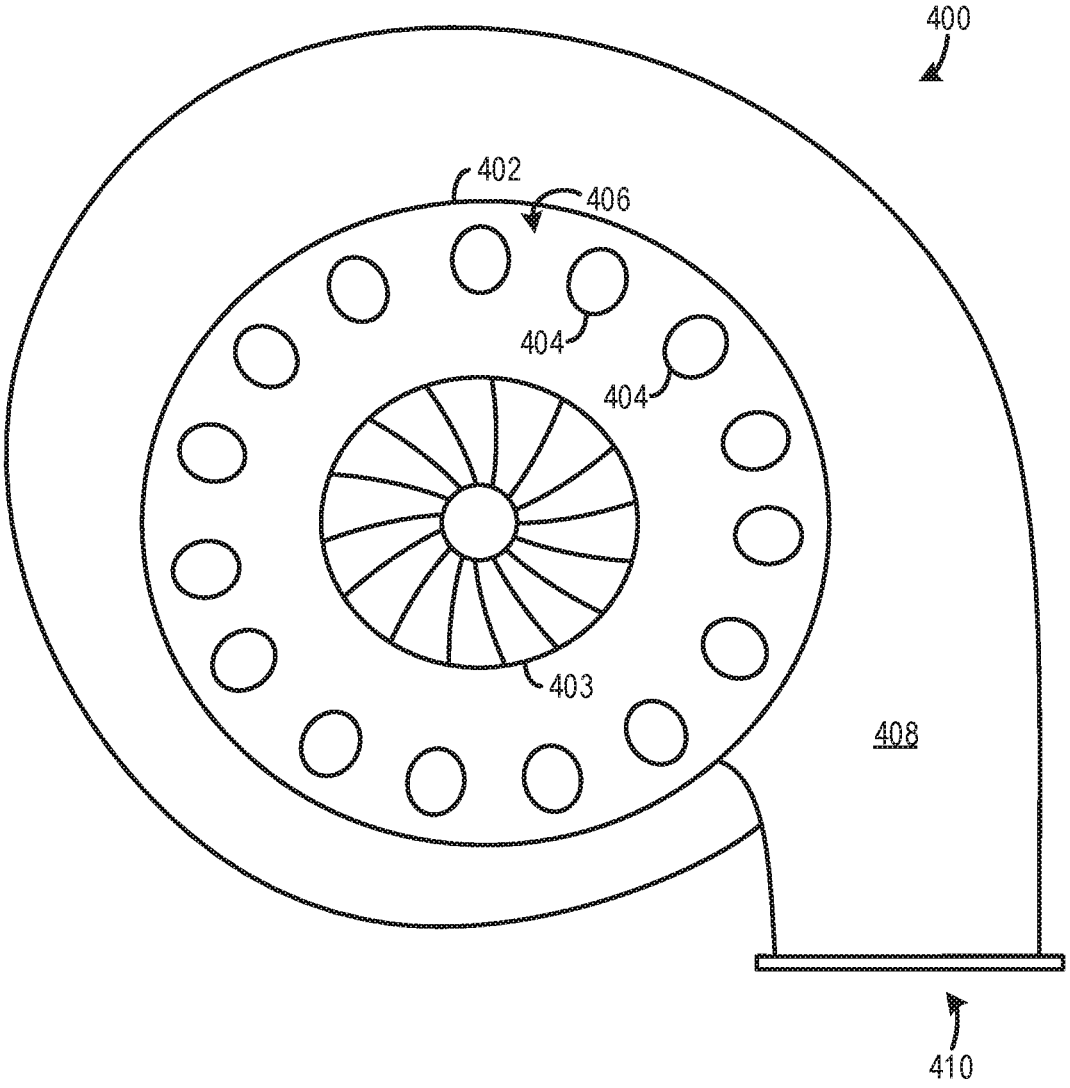
FIG. 4 shows a front view of an exemplary compressor.
Figure 5:
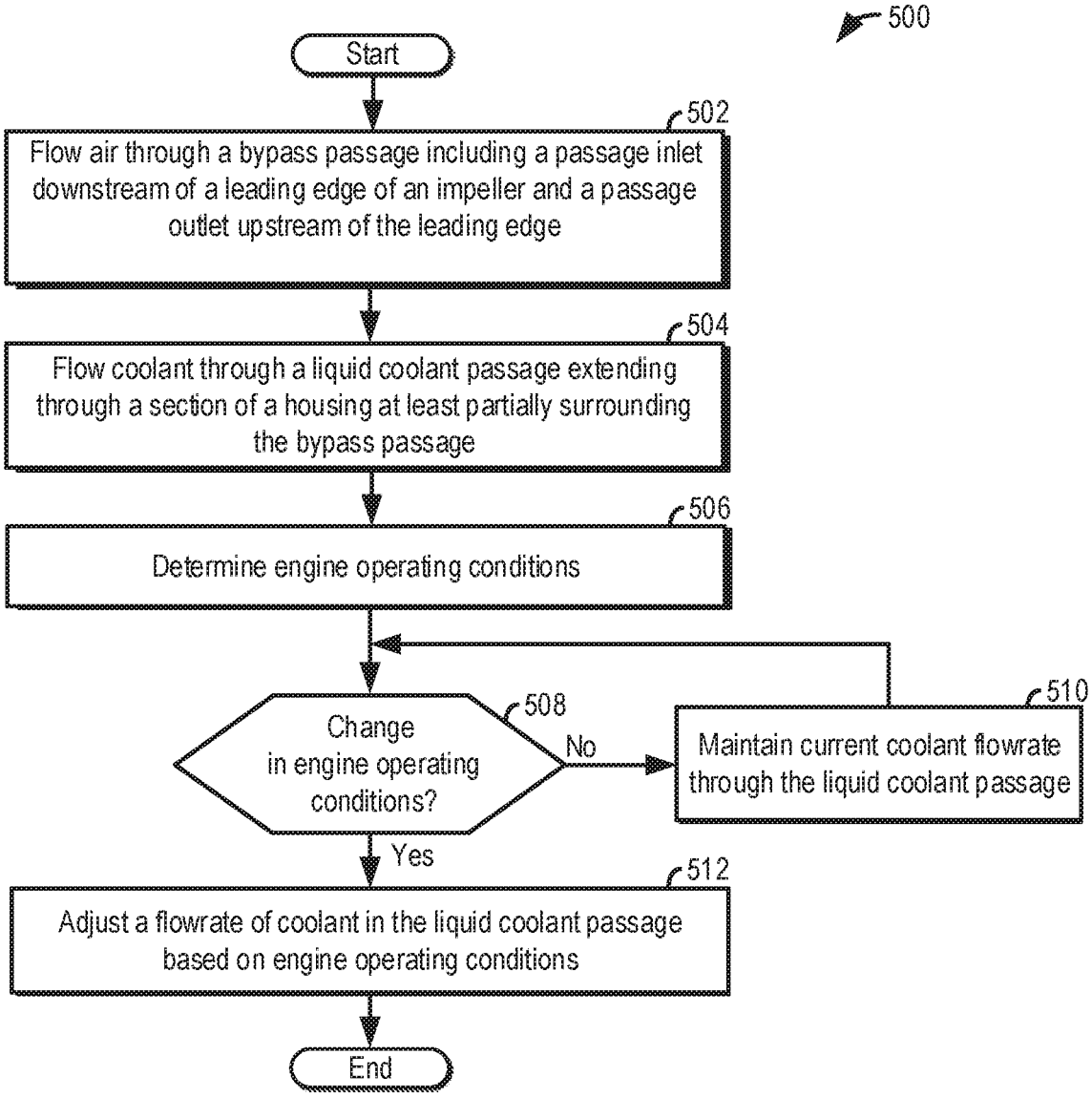
FIG. 5 shows a method for operating of a cooling system.

FIG. 1 shows an internal combustion engine with a cooling system that can provide coolant to both a cylinder block as well as a turbocharger compressor. In this way, the cooling system can be leveraged to provide cooling to multiple systems, increasing engine efficiency. FIGS. 2-3 show an exemplary compressor, during different operating conditions, with cooling channels routed next to a bypass passage (e.g., ported shroud) to enable cooling of air flowing through the bypass passage. FIG. 4 shows a front view of an exemplary compressor with a plurality of bypass passage ports. FIG. 5 shows a method for operating a cooling system to provide cooling to air flowing through the bypass passage. Cooling the air flowing through the bypass increases compressor efficiency.

Turning to FIG. 1, an engine 10 with a cooling system 12 in a vehicle 14 is schematically illustrated. The cooling system 12 provides cooling of targeted regions in a compressor to increase compressor efficiency. Although, FIG. 1 provides a schematic depiction of various engine and cooling system components, it will be appreciated that at least some of the components may have a different spatial positions and greater structural complexity than the components shown in FIG. 1. The structural details of the components are discussed in greater detail herein with regard to FIGS. 2-4.

An intake system 16 providing intake air to a combustion chamber 18 is also depicted in FIG. 1. The combustion chamber 18 is formed by a cylinder block 20 coupled to a cylinder head 22. Although, FIG. 1 depicts the engine 10 with one cylinder. The engine 10 may have an alternate number of cylinders, in other examples. For instance, the engine 10 may include two cylinders, three cylinders, six cylinders, etc., in other examples. A piston 24 is disposed in the combustion chamber 18. Additionally, the piston 24 is coupled to a crankshaft 26, denoted via arrow 28. The arrow 28 may denote a piston rod and/or other suitable components attaching the piston 24 to the crankshaft 26.

The intake system 16 includes an intake conduit 30 providing air to a compressor 32. The compressor 32 is therefore included in the intake system 16. In the illustrated example, the compressor 32 is included in a turbocharger 34. However, in other examples the compressor 32 may be driven by rotational output from the crankshaft, an electric motor, etc. For instance, the compressor may be included in a supercharger, in other examples. The compressor 32 is positioned upstream of a throttle 34, in the illustrated example. However, other compressor 32 locations have been contemplated. An intake conduit 36 provides fluidic communication between the compressor 32 and a throttle 34. The throttle 34 is configured to regulate the amount of airflow provided to the combustion chamber 18. In the depicted example, an intake conduit 38 feeds air to an intake valve 40 from the throttle 34. However, in other examples, such as in the case of a multi-cylinder engine, the intake system may further include an intake manifold.

The intake valve 40 may be actuated by an intake valve actuator 42. Likewise, an exhaust valve 44 may be actuated by an exhaust valve actuator 46. In one example, both the intake valve actuator 42 and the exhaust valve actuator 46 may employ cams coupled to intake and exhaust camshafts, respectively, to open/close the valves. Continuing with the cam driven valve actuator example, the intake and exhaust camshafts may be rotationally coupled to a crankshaft. Further in such an example, the valve actuators may utilize one or more of cam profile switching (CPS), variable cam timing (VCT), variable valve timing (VVT) and/or variable valve lift (VVL) systems to vary valve operation. Thus, cam timing devices may be used to vary the valve timing, if desired. It will therefore be appreciated that valve overlap may occur. In another example, the intake and/or exhaust valve actuators, 42 and 46, may be controlled by electric valve actuation. For example, the valve actuators, 42 and 46, may be electronic valve actuators controlled via electronic actuation. In yet another example, combustion chamber 18 may alternatively include an exhaust valve controlled via electric valve actuation and an intake valve controlled via cam actuation including CPS and/or VCT systems. In still other embodiments, the intake and exhaust valves may be controlled by a common valve actuator or actuation system.

A fuel delivery system 48 is also shown in FIG. 1. The fuel delivery system 48 provides pressurized fuel to direct fuel injector 50 via a fuel pump 52. Additionally or alternatively, the fuel delivery system 48 may also provide pressurized fuel to a port fuel injector upstream of the intake valve. The fuel delivery system 48 may include conventional components such as fuel tanks, fuel pumps, check valves, return lines, etc., to enable fuel to be provided to the injectors at desired pressures.

An exhaust system 54 configured to manage exhaust gas from the combustion chamber 18 is also included in the vehicle 14 depicted in FIG. 1. The exhaust system 54 includes the exhaust valve 44 coupled to the combustion chamber 18, and exhaust conduit 56 (e.g., exhaust manifold). The exhaust system 54 also includes a turbine 58 included in the turbocharger 34 receiving exhaust gas from the exhaust conduit 56. The turbine 58 is coupled to the compressor 32 via a shaft 60 or other suitable mechanical components designed to transfer rotational energy from the turbine to the compressor. However, as previously discussed, the compressor may be driven via rotational output from the crankshaft, electric motor, etc.

The exhaust system 54 also includes an emission control device 62 receiving exhaust gas from an exhaust conduit 64 coupled to the turbine 58. The emission control device 62 may include filters, catalysts, absorbers, etc., for reducing tailpipe emissions. An exhaust conduit 66 directs exhaust gas downstream of the emissions control device 62.

The vehicle 14 also includes the cooling system 12. The cooling system 12 is designed to transfer heat away from the engine 10 and the compressor 32, in the illustrated example. In other examples, separate cooling systems may provide coolant to the engine and the compressor or the cooling system may provide coolant solely to the compressor. Thus, the cooling system 12 may be referred to as a compressor cooling system.

The cooling system 12 includes a pump 68 configured to circulate coolant through passages in the cooling system 12. The cooling system 12 also includes a heat exchanger 70 (e.g., radiator) designed to remove heat from coolant circulating flow through the cooling system. For instance, the heat exchanger 70 may include conduits exposed to airflow and/or coupled to cooling fins or other structures configured to enable heat to be transferred from the coolant to the surrounding air. The cooling system 12 includes a coolant passage 72 traversing the cylinder block 20. It will be appreciated that the cylinder block and/or cylinder head may include water jackets including a plurality of interconnected passages configured to remove heat from desired regions of the engine, such as engine regions around the combustion chamber 18.

The cooling system 12 also includes a liquid coolant passage 74 traversing a portion of a housing of the compressor 32. The liquid coolant passage 74 includes an inlet 76 receiving coolant from a coolant conduit 78 and an outlet 80 expelling coolant into a coolant conduit 82. It will be appreciated that the liquid coolant passage 74 is schematically illustrated in FIG. 1 and the liquid coolant passage has greater structural complexity that is discussed in greater detail herein such as with regard to FIGS. 2-3.

A valve 84 may be coupled to the coolant conduit 78 to enable the flowrate of the coolant through the liquid coolant passage to be adjusted. The valve 84 can be controlled according to the flow direction inside the bypass passage or the pressure difference between ports 216 and 220, shown in FIGS. 2-3 and described in greater detail herein. When there is reverse flow inside bypass passage or the pressure at port 216 (e.g., slot) is higher than the pressure at port 220. Valve 84 can be opened to allow coolant flow through the coolant passage to cool down the high pressure and temperature flow. When the flow inside bypass passage is from impeller upstream to downstream or the pressure at port 216 is lower than the pressure at port 220, the air flow has low temperature and valve 84 may be closed Another method to control the valve 84 is to use the look up table of compressor performance. Based on the compressor air flow and boost pressure sensor on the engine, the operating speed of the compressor as well as the mass flow of the peak efficiency at the operating speed can be calculated using the compressor performance table. Then the compressor air flow can be compared with the calculated mass flow of the peak efficiency. If the compressor is operating at lower mass flow compared to the mass flow of the peak efficiency point, then the valve 84 can be opened, for instance. If the compressor is operating at higher mass flow compared to the mass flow of the peak efficiency point, then the valve 84 can be closed, for instance.

Continuing with FIG. 1, the coolant conduit 78 and a coolant passage 86 join at a junction 87 downstream of the coolant pump 68. Likewise, the coolant conduit 82 and a coolant passage 88 join at another junction 89 upstream of the coolant pump 68 and heat exchanger 70.

The engine 10 also may include an ignition system 90 providing energy to ignition device 92 (e.g., spark plug) coupled to the combustion chamber 18. However, additionally or alternatively the engine may be configured to perform compression ignition.

The vehicle 14 may also include exhaust gas recirculation (EGR) system with an EGR conduit flowing exhaust gas from the exhaust system 54 to the intake system 16, in one example.

During engine operation, the combustion chamber typically undergoes a four stroke cycle including an intake stroke, compression stroke, expansion stroke, and exhaust stroke. During the intake stroke, generally, the exhaust valves close and intake valves open. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valves and exhaust valves are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited by a spark provided by the ignition system and/or compression, resulting in combustion. During the expansion stroke, the expanding gases push the piston back to BDC. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

FIG. 1 also shows a controller 100 in the vehicle 14. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 10. The sensors may include engine coolant temperature sensor 120, exhaust gas sensors 122, an intake airflow sensor 124, engine speed sensor 126, etc. Additionally, the controller 100 is also configured to receive throttle position (TP) from a throttle position sensor 112 coupled to a pedal 114 actuated by an operator 116.

Additionally, the controller 100 may be configured to trigger one or more actuators and/or send commands to components. For instance, the controller 100 may trigger adjustment of the valve 84, coolant pump 68, throttle 34, intake valve actuator 42, exhaust valve actuator 46, ignition system 90, and/or fuel delivery system 48. Therefore, the controller 100 receives signals from the various sensors and employs the various actuators to adjust engine operation based on the received signals and instructions stored in memory of the controller. Thus, it will be appreciated that the controller 100 may send and receive signals from the cooling system 12. Specifically, the controller may include instructions stored in memory executable by the processor 102 to adjust the valve 84 upstream of the liquid coolant passage 74 to vary a flowrate of coolant through the liquid coolant passage. In one example, the controller 100 may send signals to an actuator in the valve 84 to vary operation of the valve. The degree of valve adjustment may be determined via valve opening values stored in look-up tables correlated to engine operating conditions (e.g., engine speed, engine temperature, engine load, etc.

FIGS. 2-3 shows an exemplary compressor 200 during different operating conditions. It will be appreciated that the compressor 200 shown in FIGS. 2-3 is an example of the compressor 32 shown in FIG. 1 and therefore may be include in the vehicle 14 and cooling system 12. FIG. 2 specifically shows the compressor 200 during a surge condition when the pressure at port 216 is higher than the pressure at port 220. On the other hand, FIG. 3 shows the compressor 200 during a choke condition when the compressor works at choke condition, or the pressure at port 216 is lower than the pressure at port 220.

FIGS. 2-3 show the compressor 200 including a housing 202. A portion of the housing 202 define a boundary of an inlet passage 204. Arrow 205 indicates a downstream direction in the compressor 200 and specifically in the inlet passage 204. The inlet passage 204 may receive intake air from upstream components such as the intake passage 30, shown in FIG. 1. The inlet passage 204 directs intake air to the impeller 201. The impeller 201 is coupled to a drive shaft 206 and rotates about a rotational axis 208. A bearing 210 may be coupled to the drive shaft 206 to enable the aforementioned impeller rotation. The impeller 201 is configured to increase the pressure of the air flowing therethrough. The boosted air flows from the impeller 201 to a volute 212. The volute 212 may be coupled to downstream intake system components such as intake passage 36, shown in FIG. 1.

The compressor 200 additionally includes a bypass passage 214 traversing a portion of the housing 202. Specifically, the bypass passage 214 enables air to be directed around a section of the impeller 201. The bypass passage 214 includes a first passage port 216 downstream of a leading edge 218 of the impeller 201. The bypass passage 214 additionally includes a second passage port 220 upstream of the leading edge 218 of the impeller 201. The second passage port 220 is formed in a sidewall 222 of the housing 202, in the illustrated example. However, other port positions have been contemplated. For instance, the housing of the compressor may extend upstream of the second passage port and the second passage port may be positioned an interior wall of the housing.

In the illustrated example, an intermediate section of the bypass passage 214 is parallel to the rotational axis 208. However, other bypass passage orientations have been contemplated.

The compressor 200 also includes a liquid coolant passage 224 including an inlet 226 and an outlet 228. The inlet 226 may receive coolant from the coolant conduit 78, shown in FIG. 1. Likewise, the outlet 228 may expel coolant into the coolant conduit 82, shown in FIG. 1. In this way, coolant is circulated through the liquid coolant passage 224 to remove heat from the compressor. In particular, heat can be removed from the air flowing through the bypass passage 214. Providing cooling to the air flowing through the bypass passage enables compressor efficiency to be increase via an increase in the pressure of the airflow through the compressor.

It will be appreciated that the recirculation flow through the bypass passage 214 may have high swirl and low mass flow rate. Consequently, the cooling requirements of the coolant fluid may be reduced when compared to cooling systems providing coolant in outer portions of the turbocharger housing.

The liquid coolant passage 224 is illustrated as having an inner section 230 positioned radially inward from the volute 212 and an outer section 232 traversing a section of the housing 202 adjacent to the volute 212. An inward radial direction is indicated via arrow 234. It will be appreciated that a radial outward direction may oppose a radial inward direction. In the depicted example, the outer section 232 includes an inlet 236 and an outlet 238. However in other examples, both the inner and outer sections, 230 and 232, of the liquid coolant passage 224 may share a common inlet and outlet. Providing inner and outer coolant passage sections enables the liquid coolant passage 224 to extract a greater amount of heat from the air flowing through the bypass passage 214 and the volute 212 when compared to cooling systems routing coolant through passages spaced away from the bypass passage and volute. However, in other examples, the liquid coolant passage 224 may be spaced away from the volute 212. Further in one example, the liquid coolant passage 224 may circumferentially surround a section of the bypass passage 214. Structuring the liquid coolant passage in this way enables increased amounts of heat to be extracted from air flowing through the bypass passage 214. As a result, compressor efficiency can be increased, thereby increasing engine efficiency.

Turning specifically to FIG. 2, as illustrated, air travels through the bypass passage 214 in an upstream direction. In this way, the air is essentially recirculated around a portion of the impeller. Arrows 240 indicate the general direction of airflow through the bypass passage 214 including the first passage port 216 and the second passage port 220. It will be appreciated that a recirculation airflow pattern through the bypass passage 214 will reduce compressor surge. Consequently, wear on the bearing 210 supporting the drive shaft 206 may be reduced and noise, vibration, and harshness (NVH) caused by compressor surge is also reduced. Arrows 242 depict the general direction of coolant flow through the liquid coolant passage 224. As illustrated in FIG. 2, the general direction of coolant flow in the liquid coolant passage 224 opposes the general direction of airflow in an intermediary section of the bypass passage 214.

Turning to FIG. 3, as depicted, air travels through the bypass passage 214 in a downstream direction. Arrows 300 indicate the general direction of airflow through the bypass passage 214 including the first passage port 216 and the second passage port 220. It will be appreciated that the flowing air through the bypass passage 214 in a downstream direction enables increased amount of air to be provided to the impeller during conditions such as compressor choke conditions, to increase the range of the compressor. Consequently, compressor efficiency can be increased.

FIG. 4 shows a front view an exemplary compressor 400. It will be appreciated that the compressor 400 shown in FIG. 4 may be the compressor 200, shown in FIGS. 2-3.

The compressor 400 shown in FIG. 4 includes a housing 402 and impeller 403. The compressor 400 further includes a plurality of passage ports 404 in fluidic communication with bypass passages traversing the housing. The passage ports 404 could also be a single ring chamber, in other examples. It will be appreciated that one of the passage ports 404 may be the second passage port 220, shown in FIGS. 2-3. The passage ports 404 are positioned in a sidewall 406 of the housing, in the embodiment shown FIG. 4. Additionally, the plurality of passage ports 404 are positioned upstream of an impeller 201 including vanes 203. Furthermore in the depicted example, the plurality of passage ports 404 extend in an arc around a rotational axis 208 of the impeller 201. Arranging the plurality of passage ports 404 in this manner enable the structural integrity of the housing to remain high while providing a desired amount of airflow into or out of the bypass passage. However, other passage port positions have been contemplated.

The compressor 400 includes a volute 408 in fluidic communication with an outlet 410 that may be configured to deliver compressed air to downstream components such as the throttle 34, shown in FIG. 1.

The compressor 400, shown in FIG. 4, also includes liquid coolant passages that flow coolant around the plurality of passage ports 404 to decrease the temperature of the air flowing therethrough.

FIG. 5 shows a method 500 for operating a compressor and cooling system in an engine. The method 500 may be implemented by the compressors and cooling systems described above with regard to FIGS. 1-4 or may be implemented by other suitable compressors and cooling systems, in other examples. Instructions for carrying out method 500 and the rest of the methods included herein may be executed by a controller based on instructions stored on a memory of the controller and in conjunction with signals received from sensors of an engine and cooling system, such as the sensors described above with reference to FIG. 1. The controller may employ engine actuators of the engine and cooling system to adjust engine operation, according to the methods described below.

At 502 the method includes flowing air through a bypass passage including a passage inlet downstream of a leading edge of an impeller and a passage outlet upstream of the leading edge. Flowing air through the bypass passage may include flowing air upstream or downstream through the passage during different operating conditions. The operating conditions that induce recirculation of airflow through the bypass passage include a compressor surge condition. As previously, discussed a compressor surge condition may include a condition where the compressor operating mass flow is lower than the mass flow of the peak efficiency point at given speed. On the other hand, the operating conditions that induce downstream airflow through the bypass passage include a compressor choke condition. As mentioned above, a compressor near choke condition is a condition where the flowrate of air through the compressor is larger than the mass flow of the peak efficiency point at the given speed. Therefore, flowing air through the bypass passage may include recirculating air around a portion of the impeller during a compressor surge condition, in one example. While in another example, flowing air through the bypass passage may include flowing air in a downstream direction through the bypass passage during a compressor choke condition.

At 504 the method includes flowing coolant through a liquid coolant passage extending through a section of a housing at least partially surrounding the bypass passage. Flowing coolant through the liquid coolant passage may be brought about by operating the controller to send a signal to a valve positioned in a coolant passage supplying coolant to an inlet of the liquid coolant passage. In one example, a direction of coolant flow in the liquid coolant passage may oppose a direction of airflow in the bypass passage during a compressor surge condition. In such an example, this flow pattern may occur during a compressor surge condition. This type of reverse flow pattern enables a greater amount of heat to be transferred from the air flowing through the bypass passage to the coolant in the liquid coolant conduit. It will be appreciated that steps 502 and 504 may be implemented at overlapping time intervals to enable heat to be transferred from the air flowing through the bypass passage to coolant in the liquid coolant passage. Removing heat from the air flowing through the bypass passage enables the efficiency of the compressor to be increased through an increase in the pressure of the air flowing through the compressor. As a result, engine efficiency can be increased.

At 506 the method includes determining engine operating conditions as well as compressor operating conditions. The engine operating may include an exhaust gas flowrate, engine temperature, manifold air pressure, exhaust gas composition, exhaust gas flowrate, exhaust gas temperature, throttle position, engine speed, engine load, etc. Determining engine operating conditions may include receiving signals at a controller from engine sensors and ascertaining the conditions from the sensor signals, in one instance. In other examples, certain operating conditions may be ascertained from correlations drawn between different parameters.

Next at 508 the method includes determining if a changes in engine operating conditions and/or compressor operating conditions has occurred. If a change in engine operating conditions has not occurred (NO at 508) the method advances to 510. The method includes, at 510, maintaining the current coolant flowrate through the liquid coolant passage. Maintaining the current coolant flowrate may include maintaining a valve in a coolant passage supplying coolant to an inlet of the liquid coolant passage in its current position.

Conversely, if a change in engine operating conditions has occurred (YES at 508) the method advances to 512. At 512 the method includes adjusting a flowrate of coolant in the liquid coolant passage based on engine and/or compressor operating conditions. Adjusting the flowrate of coolant in the liquid coolant passage may include adjusting a valve in a coolant passage supplying coolant to the liquid coolant passage to increase or decrease the flowrate of coolant in the liquid cooling passage. For instance, the flowrate of coolant in the liquid coolant passage may be increased in response to an increase in engine speed and decreased responsive to a decrease in engine speed. In yet another example, the flowrate of the coolant may be increased in response to an increasing in engine throttling and decreased responsive to a decrease in engine throttling. In yet another example, coolant flow through the liquid coolant passage may be decreased (e.g., inhibited) when the compressor is not experiencing surge.

The technical effect of providing coolant flow through a coolant passage adjacent to a bypass passage is increased compressor efficiency brought about by an increase in air pressure caused by the cooling of the air. Consequently, engine efficiency may be correspondingly increased.

FIGS. 2-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention will further be described in the following paragraphs. In one aspect, a compressor is provided. The compressor includes an impeller receiving air from an inlet passage, a housing surrounding the impeller, a bypass passage including a first passage port positioned downstream of a leading edge of the impeller and a second passage port positioned upstream of the leading edge, and a liquid coolant passage extending through a section of the housing at least partially surrounding the bypass passage.

In another aspect, a method for operating a compressor in an engine turbocharger, includes flowing air through a bypass passage including a passage inlet downstream of a leading edge of an impeller and a passage outlet upstream of the leading edge, and flowing coolant through a liquid coolant passage extending through a section of a housing at least partially surrounding the bypass passage. In a first example of the method the method may further include adjusting a flowrate of coolant in the liquid coolant passage based on an engine operating condition and a compressor operating condition. In another example of the method flowing air through the bypass passage may include recirculating air around a portion of the impeller during a compressor surge condition. In another example of the method, flowing air through the bypass passage may include flowing air in a downstream direction through the bypass passage during a compressor choke condition. In yet another example of the method, the engine operating condition may be engine speed and the compressor operating condition may include compressor speed and compressor flow rate. In another example of the method a direction of coolant flow in the liquid coolant passage may oppose a direction of airflow in the bypass passage during a compressor surge condition.

In another aspect, a compressor cooling system is provided. The compressor cooling system includes a liquid coolant passage extending through a portion of a housing and including an inner section positioned radially inward from a bypass passage, the bypass passage extending upstream and downstream of a leading edge of an impeller and a pump in fluidic communication with the liquid coolant passage.

In any of the aspects or combinations of the aspects, the liquid coolant passage may include an inner section positioned radially inward from a volute and the volute may be in fluidic communication with the impeller.

In any of the aspects or combinations of the aspects, the liquid coolant passage may include an outer section traversing a portion of the housing adjacent to the volute.

In any of the aspects or combinations of the aspects, the liquid coolant passage may circumferentially surround the bypass passage.

In any of the aspects or combinations of the aspects, a direction of coolant flow in the liquid coolant passage may oppose a direction of airflow in the bypass passage during a compressor surge condition.

In any of the aspects or combinations of the aspects, the second passage port may be formed in a sidewall of the housing.

In any of the aspects or combinations of the aspects, an outlet of the liquid coolant passage may be in fluidic communication with a heat exchanger and where the heat exchanger receives coolant from a coolant passage extending through a cylinder block.

In any of the aspects or combinations of the aspects, the first passage port may be axially offset from a leading edge of the impeller.

In any of the aspects or combinations of the aspects, the pump may be in fluidic communication with an engine coolant passage and heat exchanger.

In any of the aspects or combinations of the aspects, the compressor cooling system may further include a controller including code stored in memory executable by a processor to: adjust a valve upstream of the liquid coolant passage to vary a flowrate of coolant through the liquid coolant passage.

In any of the aspects or combinations of the aspects, the liquid coolant passage may circumferentially surround the bypass passage.

In any of the aspects or combinations of the aspects, a direction of coolant flow in the liquid coolant passage may oppose a direction of airflow in the bypass passage during a compressor surge condition.

In any of the aspects or combinations of the aspects, the liquid coolant passage may include an outer section traversing a portion of the housing adjacent to the volute.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A compressor comprising:

an impeller receiving air from an inlet passage;

a housing surrounding the impeller;

a bypass passage including:

a first passage port positioned downstream of a leading edge of the impeller; and a second passage port positioned upstream of the leading edge; and a liquid coolant passage including an inner section extending through a section of the housing and positioned radially inward from the bypass passages;

where the inner section extends upstream from the leading edge of the impeller and where upstream is a direction opposing a general direction of airflow through the inlet passage during compressor operation.

2. The compressor of claim 1, where the inner section is positioned radially inward from a volute and where the volute is in fluidic communication with the impeller.

3. The compressor of claim 2, where the liquid coolant passage includes an outer section traversing a portion of the housing adjacent to the volute.

4. The compressor of claim 1, where the liquid coolant passage circumferentially surrounds the bypass passage.

5. The compressor of claim 1, where a direction of a coolant flow in the liquid coolant passage opposes a direction of airflow in the bypass passage during a compressor surge condition.

6. The compressor of claim 1, where the second passage port is formed in a sidewall of the housing.

7. The compressor of claim 1, where an outlet of the liquid coolant passage is in fluidic communication with a heat exchanger and where the heat exchanger receives coolant from a coolant passage extending through a cylinder block.

8. The compressor of claim 1, where the first passage port is axially offset from the leading edge of the impeller.

9. A method for operating a compressor in an engine turbocharger, comprising:

flowing air through a bypass passage including a passage inlet downstream of a leading edge of an impeller and a passage outlet upstream of the leading edge; and flowing coolant through an inner section of a liquid coolant passage extending through a section of a housing and positioned radially inward from the bypass passage;

where the inner section extends upstream from the leading edge of the impeller and where upstream is a direction opposing a general direction of airflow through an inlet passage of the impeller during compressor operation.

10. The method of claim 9, where flowing air through the bypass passage includes recirculating the air around a portion of the impeller during a compressor surge condition.

11. The method of claim 9, where flowing the air through the bypass passage includes flowing air in a downstream direction through the bypass passage during a compressor choke condition.

12. The method of claim 9, further comprising adjusting a flowrate of the coolant in the liquid coolant passage based on an engine operating condition and a compressor operating condition.

13. The method of claim 12, where the engine operating condition is an engine speed and the compressor operating condition includes a compressor speed and a compressor airflow rate.

14. The method of claim 9, where a direction of the coolant flow in the liquid coolant passage opposes a direction of airflow in the bypass passage during a compressor surge condition.

15. A compressor cooling system, comprising:

a liquid coolant passage extending through a portion of a housing and including an inner section positioned radially inward from a bypass passage, where the bypass passage extends upstream and downstream of a leading edge of an impeller; and a pump in fluidic communication with the liquid coolant passage;

where the inner section extends upstream from the leading edge of the impeller and where upstream is a direction opposing a general direction of airflow through an inlet passage of the impeller during compressor operation.

16. The compressor cooling system of claim 15, where the pump is in fluidic communication with an engine coolant passage and a heat exchanger.

17. The compressor cooling system of claim 15, further comprising a controller including code stored in memory executable by a processor to:

adjust a valve upstream of the liquid coolant passage to vary a flowrate of coolant through the liquid coolant passage.

18. The compressor cooling system of claim 15, where the liquid coolant passage includes an outer section at least partially circumferentially surrounding the bypass passage.

19. The compressor cooling system of claim 15, where a direction of a coolant flow in the liquid coolant passage opposes a direction of airflow in the bypass passage during a compressor surge condition.

20. The compressor cooling system of claim 15, where the liquid coolant passage includes an outer section traversing a portion of the housing adjacent to a volute.

* * * * *